United States Patent [19]

Cobb

[11] 3,970,889

[45] July 20, 1976

[54] ERASURE MEANS FOR CHARGE STORAGE DEVICE

[75] Inventor: G. Harold Cobb, Beaverton, Oreg.

[73] Assignee: Tektronix, Inc., Beaverton, Oreg.

[22] Filed: Nov. 21, 1973

[21] Appl. No.: 525,793

Related U.S. Application Data

[63] Continuation of Ser. No. 365,394, May 30, 1973.

[52] U.S. Cl. ..... 313/396

[51] Int. Cl.² ..... H01J 29/08; H01J 29/10; H01J 29/39

[58] Field of Search ..... 313/396

[56] References Cited

UNITED STATES PATENTS

| | | | |
|---|---|---|---|
| 2,122,095 | 6/1938 | Gabor | 313/398 |
| 2,777,060 | 1/1957 | Waters | 313/394 |
| 2,821,653 | 1/1958 | Dyer | 313/393 |
| 3,179,833 | 4/1965 | Callick et al. | 313/396 |
| 3,293,473 | 12/1966 | Anderson | 313/398 |
| 3,312,850 | 4/1967 | McMillan et al. | 313/398 |
| 3,796,910 | 3/1974 | Ritz | 313/398 |

FOREIGN PATENTS OR APPLICATIONS

| | | |
|---|---|---|
| 651,386 | 3/1951 | United Kingdom |

*Primary Examiner*—Robert Segal
*Attorney, Agent, or Firm*—George T. Noe

[57] ABSTRACT

In a charge storage device, such as a high resolution scan converter tube, flood guns are incorporated to scan the target with substantially unfocused high current electron beams to provide the erasure thereof.

12 Claims, 4 Drawing Figures

ERASURE MEANS FOR CHARGE STORAGE DEVICE

This is a continuation of application Ser. No. 365,394 filed May 30, 1973.

BACKGROUND OF THE INVENION

The subject matter of the present invention relates generally to electron image storage apparatus, and in particular high resolution scan conversion type storage tubes and the method of erasure of such tubes.

In conventional charge storage scan conversion tubes, it has been a common practice to employ a single electron gun to perform the necessary writing, reading, and erasure functions of the dielectric target structure therein. Such operation is facilitated by well-known techniques, such as proper manipulation of electron beam current and target backplate voltages for the various functions.

In high resolution scan conversion systems, and particularly in focus projection and scanning electron beam systems where small tube size and low power consumption are essential, an extremely narrow electron beam is required to provide the fine spot of this beam on the target for writing and reading. Such a narrow beam is usually ensured by providing a disk portion of the electron gun with a very small aperture for passage therethrough of the electron beam. However, while the small aperture defines the radial extent of the beam, it unfortunately also limits the beam current, and thus erasure of the storage dielectric is severely affected. Hitherto, erasure has been accomplished by scanning the target many times using the reading beam to remove the charge. Consequently, the time required for complete erasure is considerable and the usefulness of the device is thereby limited.

SUMMARY OF THE INVENTION

According to the present invention, at least one additional electron gun is utilized for the erasure function in a focus projection and scanning system such as disclosed in U.S. patent application Ser. No. 277,901 filed Aug. 4, 1972, now U.S. Pat. No. 3,796,910, Mar. 12, 1974. Such additional gun, hereinafter called a flood gun, does not have the small beam-defining aperture that the write-read beam has, and is capable of producing a high current electron beam. The flood gun is positioned between the focusing structure and the deflection structure, and parallel to the center axis of the tube. This allows the flood erasure beam to be only partially focused and to be scanned by the deflection structure utilized by the write-read beam.

Erasing efficiency is increased by employing two flood guns, each one scanning approximately half the target. A small spot size is not characteristic of this erasure method; however, a smaller portion of the target may be erased in the scanning process, allowing split-screen effects or similar effects. Further, this erasure system may be utilized in any application where high resolution erasure of store information is not required.

It is therefore one object of the present invention to provide a high current erasure beam in a high resolution scan converter system.

It is another object of the present invention to reduce time required for erasure in a high resolution scan converter system and thereby expand the usefulness of the device.

It is a further object of the present invention to provide an improved focus projection and scanning electron beam deflection system in which a high current electron gun for erasure is utilized in addition to the write-read gun whereby both guns share a common deflection structure.

Further objects, features, and advantages will be apparent from consideration of the following description taken in conjunction with the accompanying drawings.

DRAWINGS

DETAILED DESCRIPTION OF THE DRAWINGS

Figure 1:
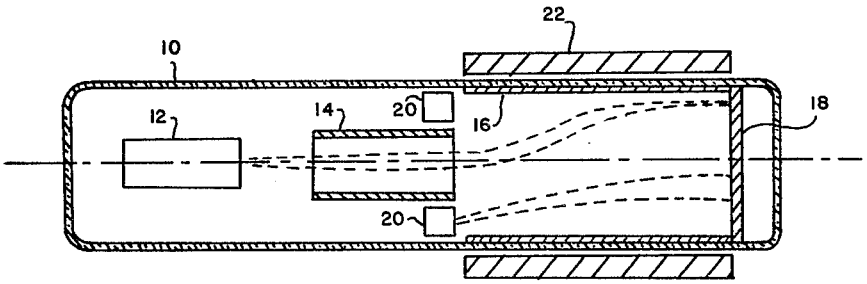
FIG. 1 is a simplified schematic view of an electron beam tube illustrating a preferred embodiment of the invention therein.

Turning now to FIG. 1, a schematic longitudinal section of an electron beam tube is shown. The tube comprises an evacuated cylindrical envelope 10 which contains the usual elements of a focus projection and scanning system, including an electron gun 12, an electrostatic focusing structure 14, a cylindrical electrostatic deflection yoke or deflectron 16, and a target means 18. In addition to these elements, the tube also includes a pair of flood guns 20. Outside the tube, a cylindrical focus solenoid 22 is positioned adjacent the deflectron 16.

Electron gun 12 is positioned on the longitudinal center axis of the tube and it generates a longitudinally-directed electron beam of narrow divergence angle. Typically, electron gun 12 has a beam-defining aperture to limit the radial extent of the beam. This beam passes through the focusing structure 14 and is further focused and deflected by the action of the solenoid 22 and deflectron 16, and arrives at the target 18 to produce a fine, high-resolution spot which is scanned across the target.

Scanning voltage waveforms are applied to the X and Y electrodes of the deflectron 16 in accordance with conventional practice, and signals are read out electrically from the target in accordance with conventional readout techniques.

The flood guns 20 are positioned parallel to the longitudinal center axis adjacent the entry of the deflectron 16. A convenient place to mount such flood guns is on the deflection shield (not shown), which is a circular disk separating the deflection field from the focusing field and having apertures therein to allow passage therethrough of the electron beams from the electron gun 12 and the flood guns 20. The flood guns 20 provide high current electron beams which are deflected in a scanning manner by the deflectron 16. The flood gun beams are not affected by the focusing structure 14, but are slightly affected by the focusing solenoid 22. The beams provide a comparatively large spot on the storage target to permit rapid erasure of large areas. Two flood guns 20 are provided in the preferred embodiment of the present invention, each one scanning only half the target. Erasing efficiency is thereby increased. Complete erasure is ensured for each scan by providing a slight overlap of flood gun beams at the center of the target 18.

Figure 2:
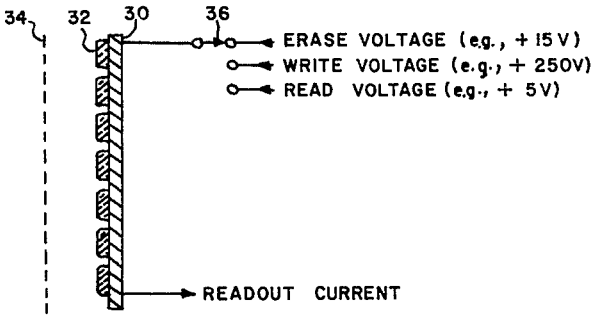
FIG. 2 is an enlarged cross-sectional view of the storage target structure.

The details of target 18 are shown in FIG. 2. Backplate structure 30 is a conductive member to which dielectric target members 32 are adhered. The target members 32 can be of such insulating material as silicon oxide. A fine mesh electrode 34 is placed in front of the target structure 18, preferably as close to deflectron 16 as possible.

Figure 3:
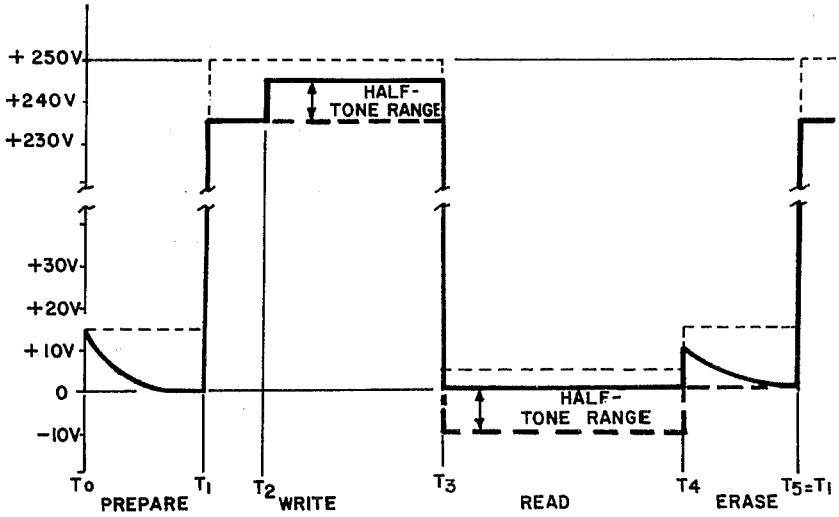
FIG. 3 illustrates one complete cycle of the voltage potentials present on the storage dielectric through the writing, reading, and erasing sequence.

Taking the voltage waveform of FIG. 3 in conjunction with FIG. 2, one complete cycle of operation of the target 18 will be discussed to show the advantage of the flood-gun erasing method. Assume the tube has been turned off and is going to be turned on at $T_0$. The target backplate 30 and the surface of the target dielectric 32 are both at zero volts potential initially. At $T_0$, the flood guns 20 are turned on as the switch 36 is placed in the erase voltage position. For this example, +15 volts is applied to the backplate, and through capacitive coupling, the surface of dielectric 32 steps also to +15 volts. The flood gun cathode potential is zero volts, and as the electrons emitted from flood gun 20 land on the surface of dielectric 32, this surface charges down to zero volts. This is shown in FIG. 3, where the dashed line between $T_0$ and $T_1$ represents the +15-volt backplate potential, and the solid line moving exponentially from +15 volts to zero volts represents the target dielectric surface. The time between $T_0$ and $T_1$ is the prepare time, and the high electron beam current from flood gun 20 allows the target to charge quickly. The entire target is initially prepared in about one-thirtieth of a second, which is equivalent to 1 TV frame.

At $T_1$, the flood gun 20 is turned off and switch 36 is moved to the write voltage position. In this example, the backplate 30 is stepped to +250 volts and through capacitive coupling, the surface of target dielectric is stepped positive an equal amount, to +235 volts. Again, the dashed line represents the backplate voltage and the solid line represents the target surface voltage. The difference between these two lines is the amount of charge held by the target dielectric 32.

At $T_2$, electron gun 12 is turned to write an image upon the target 18. As the narrow writing beam scans across the target dielectric 32, secondary electrons are jarred loose from the target surface and are collected by the backplate 30 or the mesh electrode 34, which is kept at a potential of +300 volts throughout the complete cycle. As secondary electrons leave the target dielecric 32, such dielectric loses some of its charge and the surface voltage thereof moves positive. A half-tone range is shown in FIG. 3 to indicate the range from an unwritten target (at +235 volts) to a fully written target (at +245 volts). Thus the half-tone range is 10 volts, and the target surface can be at any potential therebetween, depending on the intensity of the writing beam from electron gun 12. With different incremental target areas at different voltages in the half-tone range, a half-tone image can be effectively stored using conventional techniques.

Figure 4:
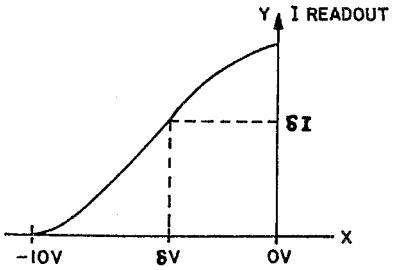
FIG. 4 illustrates a plot of voltage versus current representing the half-tone range of the storage dielectric.

At $T_3$, switch 36 is moved to the read voltage position. In this example, the backplate 30 is stepped negative to +5 volts. The target dielectric 32 is stepped negatively by an equal amount, so that the half-tone range is between zero and −10 volts. In this condition, as the target is scanned by the narrow beam from electron gun 12, the electrons therefrom do not actually strike the target. Rather, the electrons are repelled by the negative voltage on the surface of dielectric 32, and are then collected by the target backplate 30 or by the mesh electrode 34. The amount of beam current collected by the backplate 30 is a function of the negative voltage on the surface of dielectric 32. This phenomena is shown in the graph of FIG. 4, where the X axis represents the target dielectric surface voltage and the Y axis represents the beam current collected by the backplate 30. As can be determined from the graph, an incremental target voltage of $\delta V$ between 0 and −10 volts results in a current of $\delta 1$. The current $\delta$ 1 is the readout current, which is utilized in the conventional manner to develop a readout signal for display purposes.

At $T_4$, switch 36 is moved to the erase voltage position and flood gun 20 is turned on. The backplate voltage steps to +15 volts. The target surface follows, then quickly charges back down to zero volts. From this, it can be seen that the prepare and erase portions of the operation cycle are identical, and at $T_5 = T_1$ the target is unwritten and prepared to receive new data.

Many modifications of the invention will occur to those skilled in the art. For example, various arrangements of focusing may be used to control the flood gun beam width to facilitate selective erasure of the storage target. However, these changes, and many others which may appear, are within the scope and spirit of this invention.

I claim:

1. A charge storage scan conversion apparatus, comprising:

an evacuated envelope having a longitudinal axis;

storage target means mounted within said envelope, said target means including a storage element of dielectric material provided on a target electrode;

write-read means for producing a low-current first electron beam of narrow divergence angle, said write-read means including first electron gun means;

erase means for producing a high-current second electron beam, said erase means including second electron gun means; and scanning means for deflecting said first and second electron beams across the surface of said storage target in a predetermined manner.

2. The apparatus according to claim 1 wherein said first electron gun means is positioned on the centerline of said longitudinal axis, said second electron gun means is positioned parallel to said centerline, and said target means is positioned transversely to said longitudinal axis.

3. The apparatus according to claim 1 wherein said second electron gun means comprises flood gun means.

4. The apparatus according to claim 1 including first focusing means for shaping said first electron beam only, and second focusing means for shaping both said first and second electron beams.

5. The apparatus according to claim 1 wherein said scanning means is a deflectron structure.

6. An improved charge storage device comprisng:

an evacuated envelope;

storage target means mounted within said envelope for storing images thereon;

means for producing a low-current electron beam of narrow divergence angle for reading said images stored on said target means;

means for deflecting said low-current electron beam across the surface of said target means in a predetermined manner; and means for producing at least one high-current electron beam for erasing said target means.

7. The device according to claim 6 wherein said means for producing a low-current electron beam of narrow divergence angle is an electron gun having a beam-limiting aperture for passage therethrough of said beam; said means for deflecting said beam is a deflection electrode structure having scanning signals applied thereto; and said means for producing high-current electron beams are flood guns.

8. The device according to claim 6 wherein said means for deflecting said low-current electron beam is also for scanning said high-current electron beam.

9. The device according to claim 6 wherein said storage target means includes a conductive backplate member having dielectric material provided thereon, and said means for producing a low-current electron beam of narrow divergence angle is also for writing images upon said target means.

10. The device according to claim 9 wherein said backplate member has a high voltage level applied thereto for the writing operation of said target means, a low voltage level applied thereto for the reading operation of said target means, and an intermediate voltage level applied thereto for the erasing operation of said target means.

11. The device according to claim 6 wherein said means for deflecting said beam is a deflectron.

12. The device according to claim 6 including first focusing means for focusing said low-current beam only, and second focusing means for focusing both said low-current and high-current beams.

* * * * *